US011548713B2

(12) United States Patent
Yin et al.

(10) Patent No.: US 11,548,713 B2
(45) Date of Patent: Jan. 10, 2023

(54) SHOCK-ABSORBING BUFFER FOR BASE STATION ANTENNA

(71) Applicant: CommScope Technologies LLC, Hickory, NC (US)

(72) Inventors: Hua Yin, Jiangsu (CN); Yinqin Shao, Jiangsu (CN); Hong Ye, Jiangsu (CN); Ying Zhang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/466,029

(22) Filed: Sep. 3, 2021

(65) Prior Publication Data

US 2022/0097945 A1 Mar. 31, 2022

(51) Int. Cl.

*B65D 81/05* (2006.01)
*B65D 81/03* (2006.01)
*B65D 85/30* (2006.01)

(52) U.S. Cl.

CPC ..... *B65D 81/03* (2013.01); *B65D 85/30* (2013.01); *B65D 2581/058* (2013.01)

(58) Field of Classification Search

CPC .... B65D 81/03; B65D 81/057; B65D 81/052; B65D 25/205
USPC ..... 206/522
See application file for complete search history.

(56) References Cited

U.S. PATENT DOCUMENTS 8,960,436 B1 * 2/2015 Smith ..... B65D 81/027 53/472
2015/0090627 A1 * 4/2015 Yoshifusa ..... B65D 81/058 206/522
2015/0183566 A1 * 7/2015 Corvisier ..... A45F 3/14 206/522

* cited by examiner

*Primary Examiner* — King M Chu
(74) *Attorney, Agent, or Firm* — Myers Bigel, P.A.

(57) ABSTRACT

The present disclosure relates to a shock-absorbing buffer for a base station antenna. The base station antenna includes a first end portion having a first end surface, a second end portion having a second end surface, and a protruding element which is at least provided on the first end surface and protrudes outward. The shock-absorbing buffer includes an inner buffer member and an outer buffer member. The inner buffer member is configured to at least partially cover the protruding element, the first end portion, and the second end portion, and the outer buffer member is configured to sleeve the inner buffer member and at least partially cover the first end portion and the second end portion. The inner buffer member and the outer buffer member are respectively made into a pre-formed structure from an inflatable air bag, and the inflatable air bag can form a plurality of air columns after being inflated. At least a part of the air columns of the inner buffer member cross each other, or at least a part of the air columns of the outer buffer member cross each other, or at least a part of the air columns of the inner buffer member and at least a part of the air columns of the outer buffer member cross each other, so as to enhance the performance of the shock-absorbing buffer through a synergistic effect.

19 Claims, 4 Drawing Sheets

SHOCK-ABSORBING BUFFER FOR BASE STATION ANTENNA

RELATED APPLICATION

The present application claims priority from and the benefit of Chinese Utility Model Application No. 202022197544.5, filed Sep. 30, 2020, the disclosure of which is hereby incorporated herein in its entirety.

FIELD OF THE INVENTION

The present disclosure relates to a field of packaging and transport of base station antennas. More particularly, the present disclosure relates to a shock-absorbing buffer for a base station antenna.

BACKGROUND OF THE INVENTION

Base station antennas are widely used in cellular communication systems. The base station antenna is used to transmit radio frequency signals to and receive radio frequency signals from users, thereby achieving information transmission.

As shown in FIG. 1, a base station antenna may generally include a housing 1 and an electronic component (for example, a patch, a dipole, or a cross-dipole radiating element, not shown in FIG. 1) accommodated in the housing 1. The housing 1 includes a first end portion having a first end surface 2 and a second end portion having a second end surface 3 opposite to the first end surface 2. At least one protruding element 4 (for example, an interface element or connector for connecting various cables) which protrudes outward is usually provided on the first end surface 2 of the housing 1, and a mounting element 5 for mounting and fixing the base station antenna is usually provided on a bottom plate of the housing 1. When transporting the base station antenna, it is necessary to use some shock-absorbing buffers and to protect the base station antenna housing, the electronic component in the housing, and the protruding element provided on the first end surface of the housing.

Currently, foam and/or pads made of expanded polyethylene (EPE) materials are usually used to protect the base station antennas, and then the base station antennas are placed in cardboard boxes together with the foam and/or pads for transport. However, there are various disadvantages in the conventional method of transporting the base station antennas by putting the base station antennas into foam and/or pads made of expanded polyethylene materials. First, foam and/or expand polyethylene materials can hardly provide high-strength protection for the base station antennas, especially when there are harsh operations during handling or transport. Secondly, foam and/or expanded polyethylene materials are expensive, which increases the transport cost of base station antennas, and foam and expanded polyethylene materials occupy a large storage space, and thus are not convenient for transport and recovery. Lastly, foam and/or expanded polyethylene materials are not waterproof, and the performance of the base station antenna may be negatively impacted due to water erosion into the foam and/or expanded polyethylene materials during transport.

SUMMARY OF THE INVENTION

The objective of the present disclosure is to solve the aforementioned problem and one or more of other problems, and to achieve additional advantages.

The present disclosure relates to a shock-absorbing buffer for a base station antenna. The base station antenna may include a first end portion having a first end surface, a second end portion having a second end surface, and a protruding element which is at least provided on the first end surface and protrudes outward. The shock-absorbing buffer may include an inner buffer member and an outer buffer member. The inner buffer member is configured to at least partially cover the protruding element, the first end portion, and the second end portion, and the outer buffer member is configured to sleeve the inner buffer member and at least partially cover the first end portion and the second end portion. The inner buffer member and the outer buffer member are respectively made into a pre-formed structure from an inflatable air bag, and the inflatable air bag can form a plurality of air columns after being inflated. At least a part of the air columns of the inner buffer member cross each other, or at least a part of the air columns of the outer buffer member cross each other, or at least a part of the air columns of the inner buffer member and at least a part of the air columns of the outer buffer member cross each other.

According to an embodiment of the present disclosure, the inner buffer member includes at least a first inner buffer member and a second inner buffer member, the first inner buffer member is configured to abut the first end surface and surround the protruding element on the first end surface in a cavity defined by the first inner buffer member the second inner buffer member is configured to include a first buffer portion abutting the second end surface and a second buffer portion covering at least a part of an outer circumference of the second end portion.

According to an embodiment of the present disclosure, the outer buffer member includes a first outer buffer member and a second outer buffer member, the first outer buffer member is configured to at least partially cover the first inner buffer member and the first end portion of the base station antenna, and the second outer buffer member is configured to at least partially cover the second inner buffer member and the second end portion of the base station antenna.

According to an embodiment of the present disclosure, the first buffer portion of the second inner buffer member is made of a first inflatable air bag and a second inflatable air bag, and at least a part of air columns of the first inflatable air bag and at least a part of air columns of the second inflatable air bag cross each other.

According to an embodiment of the present disclosure, the second buffer portion of the second inner buffer member is configured to have a U-shaped cross-section, and the first buffer portion is provided at one end of the second buffer portion, so that the second inner buffer member is drawer-shaped as a whole.

According to an embodiment of the present disclosure, the inner buffer member includes two or more of the first inner buffer members.

According to an embodiment of the present disclosure, the first inner buffer member has a U-shaped, rectangular, circular, elliptical, or irregular-shaped cross-section.

According to an embodiment of the present disclosure, the inner buffer member further includes a third inner buffer member, and the third inner buffer member is configured to be arranged between the first inner buffer member and the first outer buffer member.

According to an embodiment of the present disclosure, the third inner buffer member includes a first buffer portion for surrounding e first inner butter member and a second buffer portion for covering at least a part of an outer circumference of the first end portion.

According to an embodiment of the present disclosure, the third inner buffer member is drawer-shaped as a whole.

According to an embodiment of the present disclosure, at least a part of air columns of the third inner buffer member and at least a part of air columns of the first outer buffer member cross each other.

According to an embodiment of the present disclosure, at least a part of air columns of the second inner buffer member and at least a part of air columns of the second outer buffer member cross each other.

According to an embodiment of the present disclosure, the shock-absorbing buffer further includes a bottom buffer member made of an inflatable air bag, and the bottom buffer member is configured to be placed under the base station antenna.

According to an embodiment of the present disclosure, the shock-absorbing buffer further includes at least one middle buffer member made of an inflatable air bag, and the at least one middle buffer member is configured to be placed between the first end portion and the second end portion of the base station antenna.

According to an embodiment of the present disclosure, the at least one middle buffer member has a U-shaped cross-section.

According to an embodiment of the present disclosure, both the first outer buffer member and the second outer buffer member are configured in a hat shape.

According to an embodiment of the present disclosure, each of the first outer buffer member and the second outer buffer member includes an outer buffer member body and a buffer reinforcing member provided on the outer buffer member body.

According to an embodiment of the present disclosure, the buffer reinforcing member and the outer buffer member body are integrally formed by a single inflatable air bag.

According to an embodiment of the present disclosure, the buffer reinforcing member is configured as a folded structure.

According to an embodiment of the present disclosure, the inflatable air bag includes a gas inlet and outlet, so that the inflatable air bag can be inflated to form the shock-absorbing buffer and can be deflated to recover and store the shock-absorbing buffer.

It should be noted that various aspects of the present invention described for one embodiment may be included in other different embodiments, although specific description is not made for the other different embodiments. In other words, all the embodiments and/or features of any embodiment may be combined in any manner and/or combination, as long as they are not contradictory to each other.

BRIEF DESCRIPTION OF THE DRAWINGS

The present disclosure will be better understood with reference to the following detailed description of specific embodiments of the present disclosure in combination with the attached drawings. In the drawings.

It should be understood that in all the appended drawings, the same reference numerals and signs denote the same elements. In the attached drawings, for clarity, the size of certain features is not drawn based on the scale as it may change.

DESCRIPTION OF EMBODIMENTS

The present disclosure will be described below with reference to the appended drawings, and the appended drawings illustrate several embodiments of the present disclosure. However, it should be understood that the present disclosure may be presented in many different ways and is not limited to the embodiments described below; in fact, the embodiments described below are intended to make the disclosure of the present disclosure more complete and to fully explain the protection scope of the present disclosure to those skilled in the art. It should also be understood that the embodiments disclosed in the present disclosure may be combined in various ways so as to provide more additional embodiments.

It should be understood that the words in the specification are only used to describe specific embodiments and are not intended to limit the present disclosure. Unless otherwise defined, all terms (including technical terms and scientific terms) used in the specification have the meanings commonly understood by those skilled in the art. For brevity and/or clarity, well-known functions or structures may not be described anymore in detail.

The singular forms "a", "an", "the" and "this" used in the specification all include plural forms unless clearly indicated. The words "include", "contain" and "have" used in the specification indicate the presence of the claimed features, but do not exclude the presence of one or more other features. The word "and/or" used in the specification includes any or all combinations of one or more of the related listed items.

In the specification, the term "first", "second", or "third" is only used for convenience of description and are not intended to be limiting. Any technical features represented by "first", "second", or "third" are interchangeable.

In the specification, terms expressing spatial relations such as "upper", "lower", "front", "rear", "top", and "bottom" may describe the relation between one feature and another feature in the attached drawings. It should be understood that, in addition to the orientations shown in the appended drawings, the words expressing spatial relations further include different orientations of the device in use or operation. For example, when the device in the appended drawings rotates reversely, the features originally described as being "below" other features now can be described as being "above" the other features. The device may also be oriented in other directions (rotated by 90 degrees or in other orientations), and in this case, a relative spatial relation will be explained accordingly.

Figure 1:
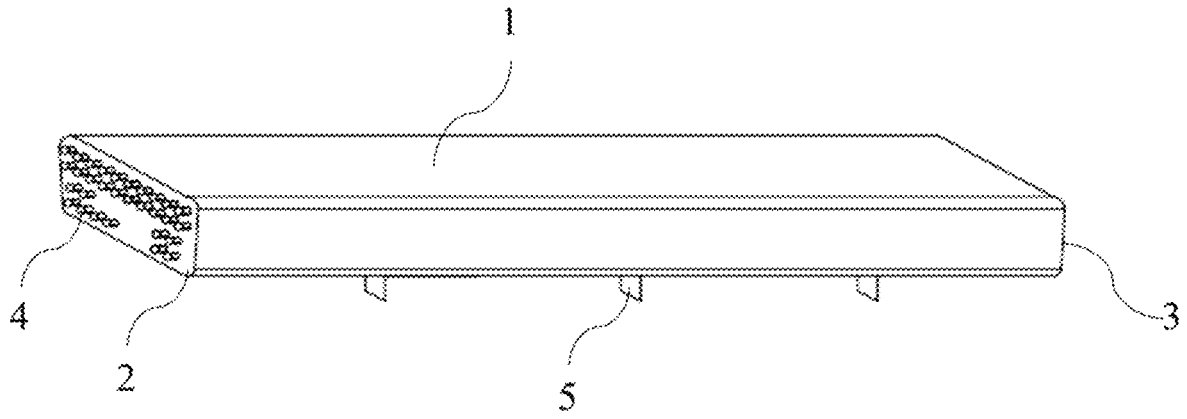
FIG. 1 is a schematic view of a base station antenna.

The present disclosure proposes a shock-absorbing buffer for protecting a base station antenna during transport of the base station antenna. The base station antenna may be a base station antenna as shown in FIG. 1, which includes a housing 1. The housing 1 may include a first end portion having a first end surface 2, a second end portion having a second end surface 3, and at least one protruding element 4 which is provided on the first end surface 2 and protrudes outward. The protruding element 4 may be an interface element or connector for connecting various cables. The shock-absorbing buffer according to the present disclosure may include an inner buffer member and an outer buffer member. The inner buffer member at least partially covers the protruding element on the base station antenna, and the first end portion and the second end portion of the base station antenna. The outer buffer member may sleeve the inner buffer member and at least partially cover the first end portion and the second end portion of the base station antenna. In this way, the inner buffer member and the outer buffer member can form a combined buffer member to provide high-strength protection to corners of the base station antenna and protruding elements thereon. In an embodiment according to the present disclosure, both the inner buffer member and the outer buffer member are made into a pre-formed structure from an inflatable air bag. The inflatable air bag can form a plurality of air columns after being inflated, and provide shock-absorbing effects through the air columns. In an embodiment according to the present disclosure, at least a part of the air columns of the inner buffer member may cross each other, or at least a part of the air columns of the outer buffer member may cross each other, or at least a part of the air columns of the inner buffer member and at least a part of the air columns of the outer buffer member may cross each other. Through such a design, a crossed air column structure can be formed in the inner buffer member, the outer buffer member, or the combined buffer member formed by the inner buffer member and the outer buffer member. The crossed air column structure can produce a synergistic effect to prevent the inner buffer member, the outer buffer member, or the combined buffer member formed by the inner buffer member and the outer buffer member from deforming in the same direction. On one hand, this can ensure that the shock-absorbing buffer can always provide constant protection to the base station antenna. during transport or impact. On the other hand, this can prevent the protruding elements of the base station antenna from puncturing the air columns and damaging the shock-absorbing buffer due to the deformation of the shock-absorbing buffer. Therefore, the shock-absorbing buffer according to the present disclosure can provide good protection for the base station even when it is subjected to a strong impact, falling or other harsh operations during transport, and the shock-absorbing buffer according to the present disclosure can meet the 2A and 3E packaging inspection standards of the International Safe Transit Association.

Specific structure of the shock-absorbing buffer according to the present disclosure will be described in detail below with reference to FIG. 2 to FIG. 8.

Figure 2:
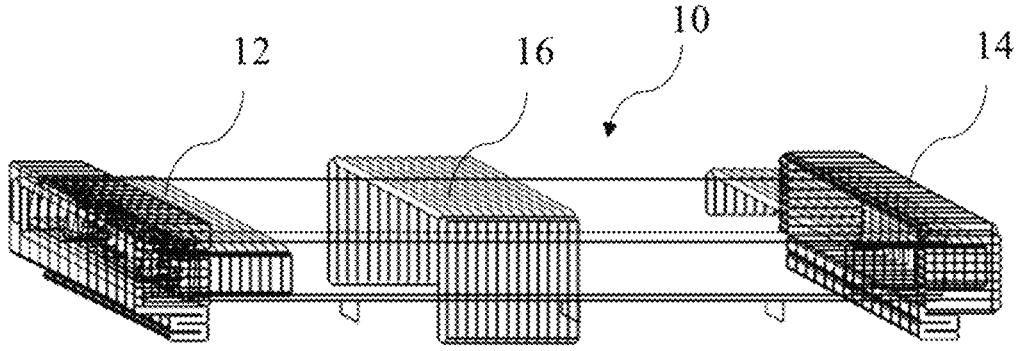
FIG. 2 shows the shock-absorbing buffer for a base station antenna according to an embodiment of the present disclosure.
Figure 3:
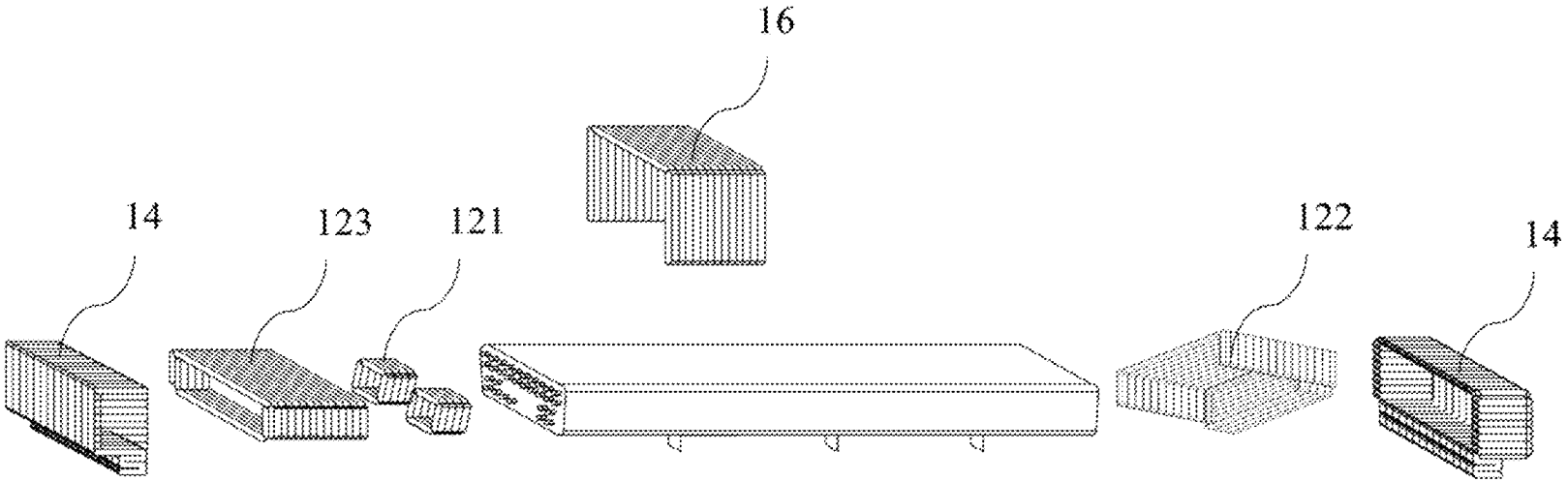
FIG. 3 is an exploded view of the shock-absorbing buffer shown in FIG. 2.

Referring to FIG. 2 and FIG. 3, the shock-absorbing buffer 10 according to an embodiment of the present disclosure is shown. The shock-absorbing buffer 10 may at least include an inner buffer member 12 and an outer buffer member 14. As mentioned above, both the inner buffer member 12 and the outer buffer member 14 may be formed into a pre-formed structure from one or more inflatable air bags. Each inflatable air bag can form a plurality of air columns after being inflated and provide shock-absorbing effects through the air columns. Each inflatable air bag may be provided with a gas inlet and outlet, so that the inflatable air bag can be inflated to form the shock-absorbing buffer 10 and can be deflated to recover and store the shock-absorbing buffer 10.

In an embodiment according to the present disclosure, the inner buffer member 12 may include a first inner buffer member 121, a second inner buffer member 122, and an optional third inner buffer member 123.

Figure 4A:
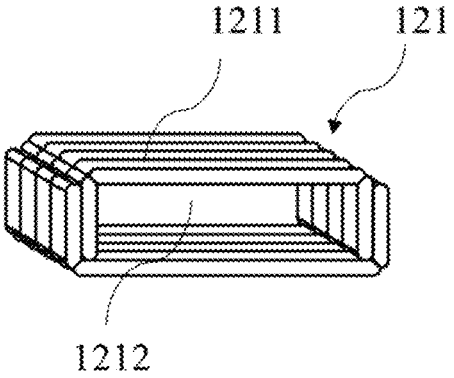
FIG. 4A and FIG. 4B respectively show two different structures of a first inner buffer member of the shock-absorbing buffer according to an embodiment of the present disclosure.
Figure 4B:
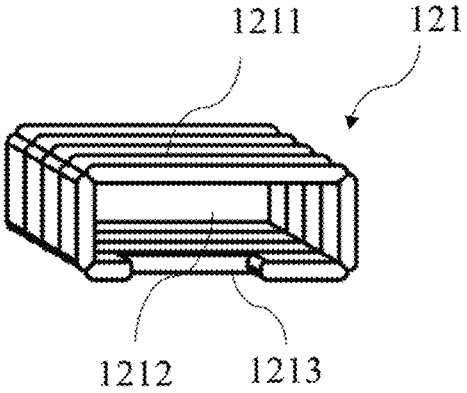

As shown in FIG. 4A, the first inner buffer member 121 may include a first inner buffer member body 1211 and a through cavity 1212 surrounded by the first inner buffer member body 1211. When the first inner buffer member 121 is mounted on the base station antenna, the first inner buffer member body 1211 can abut the first end surface 2 of the base station antenna. and surround the protruding element 4 on the first end surface 2 in the cavity 1212 to protect the protruding element 4 and prevent the protruding element 4 from contacting and damaging the outer buffer member 14. As shown in FIG. 4B, a notch 1213 may also be provided on the first inner buffer member body 1211. When the first inner buffer member 121 is mounted on the base station antenna, the notch 1213 can be used to make the first inner buffer member body 1211 avoid some protruding elements 4 that are on the first end surface 2 of the housing 1 of the base station antenna and that cannot be accommodated in the cavity 1212, so as to avoid interference between the first inner buffer member body 1211 and the protruding elements 4. If necessary, the inner buffer member 12 may include one or more first inner buffer members 121, and each first inner buffer member 121 may be used to wrap a part of the protruding element 4.

In the embodiment shown in FIG. 4A and FIG. 4B, the first inner buffer member 121 has a substantially rectangular cross-section. However, the present disclosure is not limited thereto. The first inner buffer member 121 may have a cross-section that is substantially U-shaped, circular, elliptical, irregular-shaped, or in any other shape. In an embodiment according to the present disclosure, the first inner buffer member 121 may be integrally formed by a single inflatable air bag, and include one gas inlet and outlet as a result. In other embodiments according to the present disclosure, the first inner buffer member 121 may also be formed by two or more inflatable air bags, and include two or more gas inlets and outlets as a result.

Figure 5A:
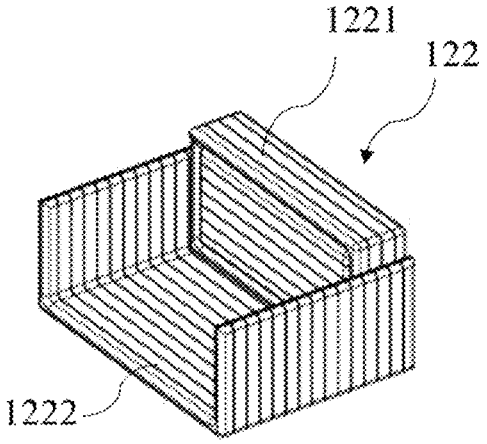
FIG. 5A and FIG. 5B show a structure of a second inner buffer member of the shock-absorbing buffer according to an embodiment of the present disclosure from different angles.
Figure 5B:
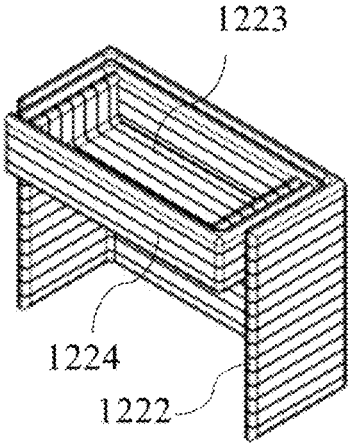

FIG. 5A and FIG. 5B respectively show the specific structure of the second inner buffer member 122 according to an embodiment of the present disclosure from different angles. The second inner buffer member 122 may include a first buffer portion 1221 for abutting the second end surface 3 of the housing 1 of the base station antenna and adapted to be sandwiched between the second end surface 3 and the outer buffer member 14, and a second buffer portion 1222 for covering at least a part of an outer circumference of the second end portion of the base station. The second buffer portion 1222 may have a substantially U-shaped structure, and the first buffer portion 1221 may be provided at one end of the second buffer portion 1222, so that the second inner buffer member 122 is drawer-shaped as a whole. When the second inner buffer member 122 is mounted on the base station antenna, it turns upside down and covers the second end portion of the base station antenna, and thus can protect at least the upper surface, two side surfaces opposite to each other, and the second end surface of the second end portion of the base station antenna.

In an embodiment according to the present disclosure, the first buffer portion 1221 may be formed by two inflatable air bags (i.e., a first inflatable air bag 1223 and a second inflatable air bag 1224), and the second buffer portion 1222 may be formed by a single inflatable air bag (in other words, the second inner buffer member 122 is generally formed by three inflatable air bags). As shown in FIG. 5B more clearly, the first inflatable air bag 1223 used to form the first buffer portion 1221 may be configured in a rectangular frame structure, and the second inflatable air bag 1224 may be configured in a U-shaped structure. The second inflatable air bag 1224 can be placed in the first inflatable air bag 1223, and air columns of the vertical part of the second inflatable air bag 1224 and air columns at an opposite side portion of the first inflatable air bag 1223 can be made to cross each other (that is, extend forming an angle with each other), thereby forming a substantially crossed side portion structure. Such a cross structure can enhance the side strength of the first buffer portion 1221 to prevent it from easily deforming in a single direction when being squeezed or impacted, thereby providing high-strength protection for the second end portion of the base station antenna.

In another embodiment according to the present disclosure, air columns on a side portion of the first buffer portion 1221 and air columns on a side portion of the second buffer portion 1222 may also cross each other, thereby further enhancing the side strength of the entire second inner buffer member 122 and providing higher strength protection for the second end portion of the base station antenna as a result. Moreover, when mounted on the second end portion of the base station antenna, the air columns of the second inner buffer member 122 and the air columns of the outer buffer member 14 may be made to cross each other as shown in FIG. 2) so as to provide higher strength protection for the second end portion of the base station antenna.

Figure 6A:
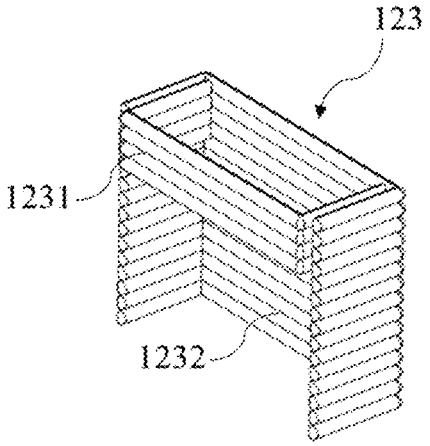
FIG. 6A and FIG. 6B show a structure of a third inner buffer member of the shock-absorbing buffer according to an embodiment of the present disclosure from different angles.
Figure 6B:
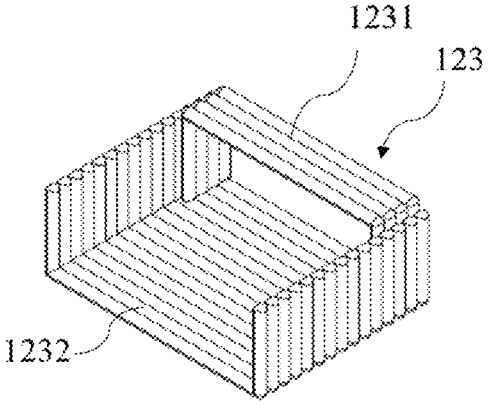

FIG. 6A and FIG. 6B show the specific structure of the third inner buffer member 123 according to an embodiment of the present disclosure. The third inner buffer member 123 may optionally be provided between the first inner buffer member 121 and the outer buffer member 14. The third inner buffer member 123 is configured to cover at least a part of an outer circumference of the first end portion of the base station antenna to protect the first end portion of the base station antenna and to further protect the protruding element provided on the first end surface 2 of the housing 1 of the base station antenna. The third inner buffer member 123 may include a first buffer portion 1231 for surrounding the first inner buffer member 121, and a second buffer portion 1232 for covering at least a part of the outer circumference of the first end portion of the base station antenna.

The second buffer portion 1232 may have a substantially U-shaped structure, and the first buffer portion 1231 may be provided at one end of the second buffer portion 1232, so that the third inner buffer member 123 is drawer-shaped as a whole. In an embodiment according to the present disclosure, the first buffer portion 1231 may have an inverted U-shaped structure, and when it is provided at one end of the second buffer portion 1232, the end of the third inner buffer member 123 may form a rectangular frame structure. In addition, the first buffer portion 1231 itself may also have a rectangular frame structure and may be arranged at one end of the second buffer portion 1232 in a manner that the rectangular frame is perpendicular to the bottom of the U-shaped structure of the second buffer portion 1232. When the third inner buffer member 123 is mounted on the base station antenna, it turns upside down and covers the second end portion of the base station antenna, and the first inner buffer member 121 is located in the rectangular frame structure of the third inner buffer member 123.

Although the air columns of the first buffer portion 1231 and the air columns of the second buffer portion 1232 are parallel to each other in the embodiment shown in FIG. 6A and FIG. 6B, the present disclosure is not limited thereto. The air columns of the first buffer portion 1231 and the air columns of the second buffer portion 1232 may cross each other to at least enhance the side strength of the third inner buffer member 123, thereby providing higher strength protection for the first end portion of the base station antenna. In addition, as shown in FIG. 2, when mounted on the base station antenna, the air columns of the third inner buffer member 123 and the air columns of the outer buffer member 14 may be made to cross each other to form a crossed air column structure so as to further provide higher strength protection for the first end portion of the base station antenna.

Figure 7:
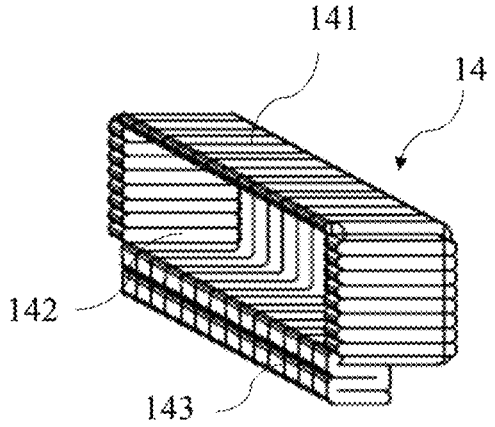
FIG. 7 shows a structure of an outer buffer member of the shock-absorbing buffer according to an embodiment of the present disclosure.

Referring to FIG. 2, FIG. 3, and FIG. 7, in an embodiment according to the present disclosure, the outer buffer member 14 may include a first outer buffer member and a second outer buffer member. The first outer buffer member is configured to at least partially cover the first inner buffer member 121, the optional third inner buffer member 123, and the first end portion of the base station antenna, and the second outer buffer member is configured to at least partially cover the second inner buffer member 122 and the second end portion of the base station antenna.

As shown in FIG. 7, both the first outer buffer member and the second outer buffer member may be configured in a hat shape, which includes an outer buffer member body 141 and a cavity 142 with a bottom surrounded by the outer buffer member body 141. When the outer buffer member 14 is mounted on the base station antenna, the end portion of the base station antenna and the inner buffer member 12 are both placed in the cavity 142 of the outer buffer member 14. In this way, the outer buffer member body 141 can surround the end portion of the base station antenna, which not only protects the outer peripheral surface and end surface of the base station antenna but also achieves the shock-absorbing function. In addition, the outer buffer member 14 having the hat-shaped structure also has a good waterproof function, which can prevent water from entering the base station antenna through gaps at the end portion of the base station antenna.

In order to enhance the shock-absorbing effects of the outer buffer member 14, the outer buffer member 14 may further include a buffer reinforcing member 143. The buffer reinforcing member 143 may be configured as a folded structure, which can be formed by folding the inflatable air bag a plurality of times. The buffer reinforcing member 143 may be integrally formed with the outer buffer member body 141 by a single inflatable air bag. In addition, a mounting element 5 for mounting and fixing the base station antenna is usually arranged on a bottom plate of the base station antenna. In order to avoid the transmission of vibration through the mounting element 5, the thickness of the buffer reinforcing member 143 is designed such that the base station antenna can be supported to a sufficient distance above the ground or an outer package to prevent the mounting element 5 from contacting the outer package.

In an embodiment according to the present disclosure, the outer buffer member 14 itself may at least partially include crossed air columns to enhance the deformation resistance and shock-absorbing performance of the outer buffer member 14 through the synergistic effect of the crossed air columns. In order to form crossed air columns, the outer buffer member 14 may be configured to be formed by two or more inflatable air bags, where the air columns of the two or more inflatable air bags cross each other.

The shock-absorbing buffer 10 according to the present disclosure may further include at least one middle buffer member 16. The middle buffer member 16 is configured to be placed between the first end portion and the second end portion of the base station antenna to further enhance the shock-absorbing effects of the shock-absorbing buffer. Each middle buffer member 16 may be configured in a U-shaped structure. When the middle butter member 16 is placed on the base station antenna as shown in FIG. 2, it can at least partially cover the upper surface and two opposite side surfaces of the base station antenna.

Figure 8:
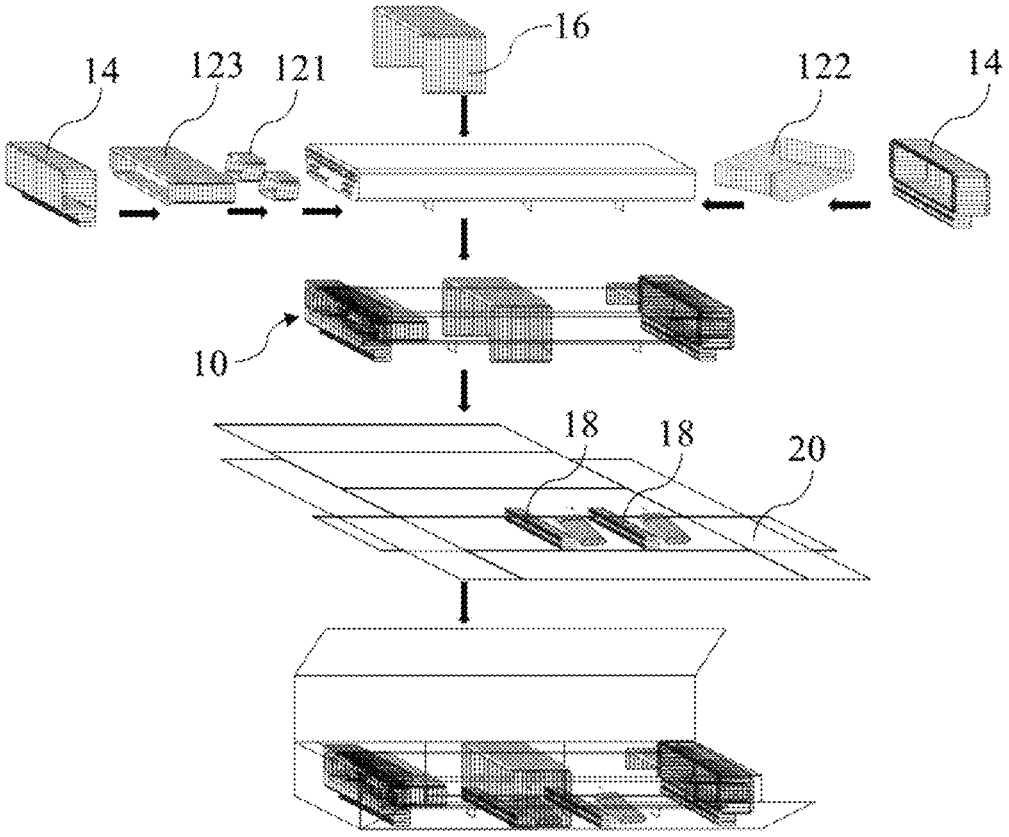
FIG. 8 is a schematic view of packaging the shock-absorbing buffer according to an embodiment of the present disclosure by using an outer package.

In order to further enhance the shock-absorbing effects, as shown in FIG. 8, the shock-absorbing buffer 10 according to the present disclosure may further include a bottom buffer member 18, which may be placed in a gap between the bottom of the base station antenna. and a package 20 to buffer the impact on the base station antenna and its internal parts due to up and down vibrations during transport. The bottom buffer member 18 may be made of an inflatable air bag into a solid structure, that is, the bottom buffer member 18 may not have a cavity. In an embodiment according to the present disclosure, the bottom buffer member 18 may be formed by folding the inflatable air bag.

After the shock-absorbing buffer according to the present disclosure is mounted on the base station antenna, the base station antenna can be directly placed in a conventional outer package (for example, a cardboard box or a box made of other materials) for transport.

FIG. 8 shows detailed steps of packaging the shock-absorbing buffer according to the present disclosure by using a conventional outer package. The following steps are performed during packaging: 1) placing the first inner buffer member 121 around the protruding element 4 on the first end surface 2 of the base station antenna to make the first inner buffer member body 1211 of the first inner buffer member 121 abut the first end surface 2 and to make the protruding element 4 be accommodated in the cavity 1212; and optionally, when the third inner buffer member 123 is present, arranging the third inner buffer member 123 on the first end portion of the base station antenna to make the second buffer portion 1232 cover at least a part of the outer circumference of the first end portion of the base station antenna (for example, at least cover the upper surface and the opposite side surfaces of the first end portion of the base station antenna) and to make the first inner buffer member 121 be accommodated in the rectangular frame structure of the third inner buffer member 123; 2) arranging the second inner buffer member 122 on the second end portion of the base station antenna to make the first buffer portion 1221 abut the second end surface 3 of the base station antenna and to make the second buffer portion 1222 cover at least a part of the outer circumference of the second end portion of the base station antenna (for example, at least cover the upper surface and the opposite side surfaces of the second end portion of the base station antenna); 3) mounting the first outer buffer member and the second outer buffer member on the first end portion and the second end portion of the base station antenna to make the first end portion and the second end portion of the base station antenna and the inner buffer member 12 be placed in the cavity 142 of the first outer buffer member and the second outer buffer member; and optionally, when the middle buffer member 16 is present, covering the base station antenna with the middle buffer member 16 upside down between the first end portion and the second end portion of the base station antenna and 4) placing the base station antenna on the outer package 20 for packaging, and when the bottom buffer member 18 is present, placing the bottom buffer member 18 in the gap between the bottom of the base station antenna and the outer package 20. The above steps can be performed in any order according to actual situations.

Various embodiments of the shock-absorbing buffer and components thereof according to the present disclosure have been described in detail above with reference to the drawings. The shock-absorbing buffer according to the various embodiments of the present disclosure all can meet the 2A and 3E packaging inspection standards of the International Safe Transit Association. In each embodiment according to the present disclosure, a material of the inflatable air bag is a co-extruded film of PA (nylon) and PE (low density polyethylene). When an inflatable air bag is used to make each buffer member into a pre-formed structure, corners can be reduced in size by air column point pressing so as to reduce the external size of each buffer member. In addition, when corresponding buffer members include crossed air column structures, these crossed air column structures can be formed by combining two or more inflatable air bags in a predetermined manner, or can be formed by directly using a single inflatable air bag having a crossed air column structure.

The shock-absorbing buffer 10 according to the present disclosure can lower the possibility of damage to the housing of the base station antenna, electronic components in the housing, and/or protruding elements on the end surface of the housing due to vibration or impact during transport. Comparing to the conventional shock-absorbing buffers, the shock-absorbing buffer according to the present disclosure has a good shock-absorbing effect, and can meet the 2A and 3E packaging inspection standards of the International Safe Transit Association, with low cost and good waterproof function. In addition, at least a part of the air columns of the shock-absorbing buffer 10 according to the present disclosure form a structure in which the air columns cross each other. Such a crossed structure has a synergistic effect so that the shock-absorbing buffer according to the present disclosure is not easily deformed when squeezed or impacted and has better resistance, thereby providing good protection for the base station antenna even when the base station antenna is subjected to a strong impact, falling or other harsh operations. Lastly, each buffer member of the shock-absorbing buffer 10 according to the present disclosure may be provided with one or more gas inlets and outlets. When the shock-absorbing buffer 10 according to the present disclosure is to be used, each buffer member of the shock-absorbing buffer can be inflated through the gas inlets and outlets. When the shock-absorbing buffer 10 according to the present disclosure is not in use, each buffer member of the shock-absorbing buffer 10 can be deflated through the gas inlets and outlets. Such a structure allows the shock-absorbing buffer 10 according to the present disclosure to occupy only a small space when not in use, and is convenient for storage and/or recovery.

Although exemplary embodiments of the present disclosure have been described, those skilled in the art should understand that many variations and modifications can be made to the exemplary embodiments without departing from the spirit and scope of the present disclosure. Therefore, all variations and changes are included in the protection scope of the present disclosure defined by the claims.

The invention claimed is:

1. A shock-absorbing buffer for a base station antenna, the base station antenna including a first end portion having a first end surface, a second end portion having a second end surface, and a protruding element which is at least provided on the first end surface and protrudes outward, wherein the shock-absorbing buffer includes an inner buffer member and an outer buffer member, the inner buffer member is configured to at least partially cover the protruding element, the first end portion, and the second end portion, and the outer buffer member is configured to sleeve the inner buffer member and at least partially cover the first end portion and the second end portion;

wherein, the inner buffer member and the outer buffer member are respectively made into a pre-formed structure, forming an inflatable air bag, and the inner and outer buffer members, each forming a plurality of air columns after being inflated; and wherein, at least a part of the air columns of the inner buffer member cross each other, or at least a part of the air columns of the outer buffer member cross each other, or at least a part of the air columns of the inner buffer member and at least a part of the air columns of the outer buffer member cross each other; and wherein the inner buffer member includes at least a first inner buffer member and a second inner buffer member, the first inner buffer member is configured to abut the first end surface and surround the protruding element on the first end surface in a cavity defined by the first inner buffer member; the second inner buffer member is configured to include a first buffer portion abutting the second end surface and a second buffer portion covering at least a part of an outer circumference of the second end portion.

2. The shock-absorbing buffer for a base station antenna according to claim 1, wherein the outer buffer member includes a first outer buffer member and a second outer buffer member, the first outer buffer member is configured to at least partially cover the first inner buffer member and the first end portion of the base station antenna, and the second outer buffer member is configured to at least partially cover the second inner buffer member and the second end portion of the base station antenna.

3. The shock-absorbing buffer for a base station antenna according to claim 2, wherein the inner buffer member further includes a third inner buffer member, and the third inner buffer member is configured to be arranged between the first inner buffer member and the first outer buffer member.

4. The shock-absorbing buffer for a base station antenna according to claim 3, wherein the third inner buffer member includes a first buffer portion for surrounding the first inner buffer member and a second buffer portion for covering at least a part of an outer circumference of the first end portion.

5. The shock-absorbing buffer for a base station antenna according to claim 4, wherein the third inner buffer member is drawer-shaped as a whole.

6. The shock-absorbing buffer for a base station antenna according to claim 3, wherein at least a part of air columns of the third inner buffer member and at least a part of air columns of the first outer buffer member cross each other.

7. The shock-absorbing buffer for a base station antenna according to claim 2, wherein at least a part of air columns of the second inner buffer member and at least a part of air columns of the second outer buffer member cross each other.

8. The shock-absorbing buffer for a base station antenna according to claim 2, wherein both the first outer buffer member and the second outer buffer member are configured in a hat shape.

9. The shock-absorbing buffer for a base station antenna according to claim 8, wherein each of the first outer buffer member and the second outer buffer member includes an outer buffer member body and a buffer reinforcing member provided on the outer buffer member body.

10. The shock-absorbing buffer for a base station antenna according to claim 9, wherein the buffer reinforcing member and the outer buffer member body are integrally formed by a single inflatable air bag.

11. The shock-absorbing buffer for a base station antenna according to claim 9, wherein the buffer reinforcing member is configured as a folded structure.

12. The shock-absorbing buffer for a base station antenna according to claim 1, wherein the inflatable air bag comprising a first and second inflatable air bag; the first buffer portion of the second inner buffer member is made of the first inflatable air bag and the second inflatable air bag, and at least a part of air columns of the first inflatable air bag and at least a part of air columns of the second inflatable air bag cross each other.

13. The shock-absorbing buffer for a base station antenna according to claim 1, wherein the second buffer portion of the second inner buffer member is configured to have a U-shaped cross-section, and the first buffer portion is provided at one end of the second buffer portion, so that the second inner buffer member is drawer-shaped as a whole.

14. The shock-absorbing buffer for a base station antenna according to claim 1, wherein the inner buffer member includes two or more of the first inner buffer members.

15. The shock-absorbing buffer for a base station antenna according to claim 1, wherein the first inner buffer member has a U-shaped, rectangular, circular, elliptical, or irregular-shaped cross-section.

16. The shock-absorbing buffer for a base station antenna according to claim 1, wherein the inflatable air bag includes a gas inlet and outlet, so that the inflatable air bag can be inflated to form the shock-absorbing buffer and can be deflated to recover and store the shock-absorbing buffer.

17. A shock-absorbing buffer for a base station antenna, the base station antenna including a first end portion having a first end surface, a second end portion having a second end surface, and a protruding element which is at least provided on the first end surface and protrudes outward, wherein the shock-absorbing buffer includes an inner buffer member and an outer buffer member, the inner buffer member is configured to at least partially cover the protruding element, the first end portion, and the second end portion, and the outer buffer member is configured to sleeve the inner buffer member and at least partially cover the first end portion and the second end portion;

wherein, the inner buffer member and the outer buffer member are respectively made into a pre-formed structure, forming an inflatable air bag, and the inner and outer buffer members, each forming a plurality of air columns after being inflated; and wherein, at least a part of the air columns of the inner buffer member cross each other, or at least a part of the air columns of the outer buffer member cross each other, or at least a part of the air columns of the inner buffer member and at least a part of the air columns of the outer buffer member cross each other; and wherein the shock-absorbing buffer further includes a bottom buffer member made of an inflatable air bag, and the bottom buffer member is configured to be placed under the base station antenna.

18. A shock-absorbing buffer for a base station antenna, the base station antenna including a first end portion having a first end surface, a second end portion having a second end surface, and a protruding element which is at least provided on the first end surface and protrudes outward, wherein the shock-absorbing buffer includes an inner buffer member and an outer buffer member, the inner buffer member is configured to at least partially cover the protruding element, the first end portion, and the second end portion, and the outer buffer member is configured to sleeve the inner buffer member and at least partially cover the first end portion and the second end portion;

wherein, the inner buffer member and the outer buffer member are respectively made into a pre-formed structure, forming an inflatable air bag, and the inner and outer buffer members, each forming a plurality of air columns after being inflated; and wherein, at least a part of the air columns of the inner buffer member cross each other, or at least a part of the air columns of the outer buffer member cross each other, or at least a part of the air columns of the inner buffer member and at least a part of the air columns of the outer buffer member cross each other; and wherein the shock-absorbing buffer further includes at least one middle buffer member made of an inflatable air bag, and the at least one middle buffer member is configured to be placed between the first end portion and the second end portion of the base station antenna.

19. The shock-absorbing buffer for a base station antenna according to claim 18, wherein the at least one middle buffer member has a U-shaped cross-section.

* * * * *